US007378582B2

(12) United States Patent
Kinoshita

(10) Patent No.: US 7,378,582 B2
(45) Date of Patent: May 27, 2008

(54) STRINGED INSTRUMENT NUT AND STRINGED INSTRUMENT

(75) Inventor: Osamu Kinoshita, Nagoya (JP)

(73) Assignee: Hoshino Gakki Co., Ltd. (JP)

( * ) Notice: Subject to any disclaimer, the term of this patent is extended or adjusted under 35 U.S.C. 154(b) by 198 days.

(21) Appl. No.: 11/326,239

(22) Filed: Jan. 5, 2006

(65) Prior Publication Data

US 2006/0156893 A1 Jul. 20, 2006

(30) Foreign Application Priority Data

Jan. 20, 2005 (JP) ..... 2005-013370
Aug. 2, 2005 (JP) ..... 2005-224277

(51) Int. Cl.
*G10D 3/06* (2006.01)

(52) U.S. Cl. ..... 84/314 N

(58) Field of Classification Search ..... 84/314 N
See application file for complete search history.

(56) References Cited

U.S. PATENT DOCUMENTS

| | | | | | |
|---|---|---|---|---|---|
| 2,191,776 | A | * | 2/1940 | Schreiber | 84/314 N |
| 4,171,661 | A | * | 10/1979 | Rose | 84/313 |
| 4,517,874 | A | * | 5/1985 | Fender | 84/314 N |
| 4,572,049 | A | * | 2/1986 | Tanaka et al. | 84/313 |
| 4,574,678 | A | * | 3/1986 | Edwards | 84/314 N |
| 4,608,906 | A | * | 9/1986 | Takabayashi | 84/313 |
| 4,669,350 | A | * | 6/1987 | Gressett et al. | 84/314 N |
| 4,709,612 | A | | 12/1987 | Wilkinson | 84/314 |
| RE32,863 | E | * | 2/1989 | Edwards | 84/314 N |
| 5,589,653 | A | * | 12/1996 | Rose | 84/314 N |
| 6,700,043 | B2 | * | 3/2004 | Hirayama | 84/314 N |
| 2006/0156893 | A1 | * | 7/2006 | Kinoshita | 84/314 N |

FOREIGN PATENT DOCUMENTS

| | | | |
|---|---|---|---|
| JP | 61-49393 | | 4/1986 |
| JP | 61-49395 | * | 4/1986 |
| JP | 62-500051 | | 1/1987 |
| JP | 63-177896 | | 11/1988 |
| JP | 2003-122367 | | 4/2003 |
| JP | 2003122367 A | * | 4/2003 |
| JP | 2003-316360 | | 11/2003 |
| JP | 2003316360 A | * | 11/2003 |

OTHER PUBLICATIONS

Japanese Office Action dated Apr. 17, 2007.

* cited by examiner

*Primary Examiner*—Lincoln Donovan
*Assistant Examiner*—Robert W Horn
(74) *Attorney, Agent, or Firm*—Ostrolenk, Faber, Gerb & Soffen, LLP

(57) ABSTRACT

A stringed instrument including strings supported by bridges, which are fixed to a body, and a nut fixed to a neck. The strings are supported in a manner enabling vibration of each string. The nut includes a nut body and a fastener. The fastener is formed by pressing members and adjustment screws. The pressing members press the strings against the nut surface so that the strings are fixed to the nut surface. A projection projecting toward the strings is formed on an end portion of the nut. The strings are supported by the nut so as to contact the top surface of the projection. This enables each string to vibrate while being in constant contact with the projection and prevents each string from coming into contact with the nut or fastener. Thus, abnormal noise is not generated.

20 Claims, 6 Drawing Sheets

STRINGED INSTRUMENT NUT AND STRINGED INSTRUMENT

BACKGROUND OF THE INVENTION

The present invention relates to a stringed instrument and to a stringed instrument nut for use in a stringed instrument such as an electric guitar.

Referring to FIG. 7, a typical electric guitar typically includes a body 61, a neck 62, and a plurality of strings 64. Tailpieces 63 and bridges 67 are arranged on the body 61 opposite to the neck 62. A stringed instrument nut (hereafter simply referred to as a "nut") 68 is arranged on the neck 62. Pegs 66, which form a tuning device, are attached to a head 65, which is set on a distal portion of the neck 62. Each string 64 has a basal end fixed to the corresponding tailpiece 63 and a distal end wound around and fixed to the corresponding peg 66. The bridges 67 and the nut 68 support the strings 64 in a state spaced from the surfaces of the body 61 and the neck 62. In this state constant tension, is applied to each string 64. When plucked, each string 64 vibrates in a state supported at contact points with the corresponding bridge 67 and the nut 68. When each string 64 vibrates, vibration in a basic-mode and vibration in wavelengths differing from that of the basic-mode vibration are mixed in a complicated manner to create a tone unique to a stringed instrument.

The electric guitar may be played using techniques known as arming and bending. Arming is a technique for changing the tones of the strings 64 by operating a tremolo arm and simultaneously changing the tensions of all the strings 64. Bending is a technique for changing the tone of each string 64 by individually changing the tension of each string 64. When the electric guitar is played using these techniques, the tension of each string 64 changes greatly. As a result, the position of each string 64 with respect to the nut 68 changes greatly. After the electric guitar is played with these techniques, the strings 64 may fail to return to their original positions because of friction resistance between the strings 64 and the nut 68. As a result, the strings 64 may go out of tune and affect the playing of the electric guitar. Each string 64 is tuned by turning the corresponding peg 66 to tighten or loosen the string 64 and adjust the tension on the string. A strong force may be applied to the peg 66 particularly when the string 64 is under high tension. This may reversely rotate the screw of the peg 66 and change the position of the peg 66.

To solve the above problems, Japanese Laid-Open Patent Publication No. 2003-122367 and U.S. Pat. No. 4,171,661 describe electric guitars that include a fastener for fixing strings to a nut. Referring to FIGS. 8 and 9, in the structures described in these documents, a surface 71 of a nut 68 is smoothly curved. Further, support walls 72 are formed on opposite ends of the nut 68. Each support wall 72 has a plurality of support grooves 73 for supporting strings 64. The support grooves 73 of one support wall 72 face the support grooves 73 of the other support wall 72. An inner bottom surface 73*a* of each support groove 73 is substantially flush with the nut surface 71. Each string 64 is received by two opposing support grooves 73 so as to restrict movement of each string 64 in the lateral direction of the neck 62.

Each string 64 is fixed in a state contacting the surface 71 of the nut 68 by a fastener 90. The fastener 90 includes pressing members 74 and adjustment screws 75. The pressing members 74 are arranged on the nut surface 71. The adjustment screws 75 fasten the pressing members 74 to the nut surface 71. A through hole 77 extends through the central portion of each pressing member 74. The adjustment screws 75 are inserted through the through holes 77. The adjustment screws 75, which are inserted through the through holes 77 of the pressing members 74, are mated with screw holes 76, which are formed in the nut surface 71. When the adjustment screws 75 are tightened, the pressing members 74 press the strings 64 against the nut surface 71 to securely fix each string 64. The fastener 90 prevents the electric guitar from going out of tune even when the electric guitar is played many times using the arming technique or the bending technique. The fastener 90 further prevents the position of each string 64 from changing after tuning.

However, when the strings 64 are securely fixed to the nut 68, stress may concentrate on points at which the strings 64 come in contact with the two ends 78*a* of each pressing member 74. In such a case, the strings 64 would have a tendency to break at these contact points. Accordingly, the curvature of the ends 78*a* of each pressing member 74 is smaller than the curvature of the other parts of the pressing member 74. This forms a clearance 79 between an end 78*a* of the pressing member 74 and the string 64 so that the pressing member 74 is slightly spaced from the nut surface 71. This structure reduces concentration of stress on each string 64. However, interference between each string 64 and the nut 68 may generate abnormal noise.

The nut 68 functions to stably support each string 64. It is thus preferable that the distal end of the nut 68 be sharp like a blade edge. However, when the nut 68 supports a string 64 with a sharp edge, only one point of the string 64 is supported by the edge. As a result, stress concentrates on the supported point of the string 64. This may easily break the string 64 or form a bending depression in the string 64 at the support point. Therefore, it is preferable that the nut 68 be formed so that its nut surface 71 is smoothly curved. More specifically, it is preferable that the nut 68 be formed so that the nut surface 71 extends, for example, along an arc. The nut 68 having the smoothly curved nut surface 71 enables a string 64 to be supported at one point and prevents stress from concentrating on that support point. However, when the nut surface 71 is smoothly curved, each string 64 approaches the nut surface 71 at locations close to the point of contact with the nut surface 71 and are gradually spaced from the nut surface 71 at locations farther from the point of contact. Accordingly, when vibrating, each string 64 has a tendency of coming into contact with the nut surface 71 and thus generating abnormal noise.

The generation of abnormal noise due to the nut 68 will now be described with reference to FIGS. 10(A) to 10(C). In the prior art, the nut 68 is shaped as shown in FIG. 10(A). The nut 68 minimizes the clearance formed between each string 64 and the nut surface 71. In this case, the angle a between the string 64 and the inner bottom surface 73*a* of the support groove 73 is substantially zero. Further, the string 64 is in contact with the nut surface 71 at an end portion of the nut 68 (as indicated by the ▲ symbol in FIG. 10(A)) when the string 64 is still. In this state, the pressing member 74 presses the string 64 against the nut surface 71 at a fixed point 80, as shown in FIG. 10(A). However, when the string 64 vibrates, the string 64 repeatedly comes into contact with and separates from the inner bottom surface 73*a* of the support groove 73 as shown in FIG. 10(B). In such a case, the string 64 may generate abnormal noise.

To solve this problem, the angle $\alpha$ between the string 64 and the inner bottom surface 73*a* of the support groove 73 may be changed so that it is greater than a predetermined value as shown in FIG. 10(C). In this case, the string 64 is supported in a state inclined relative to the nut 68. This keeps the point of contact between the string 64 and the inner bottom surface 73*a* of the support groove 73 located at the end portion of the nut 68. Referring to FIG. 7, the angle α is affected by various factors including the height of the bridges 67, the angle at which the neck 62 is connected to the body 61, the deformation amount of the neck 62, the shape of the surface to which the nut 68 is attached, and the method for fixing the nut 68. These various factors must be taken into consideration when determining the predetermined value angle α so that the point of contact between each string 64 and the nut 68 is maintained at the edge portion of the nut 68 not only when the strings 64 are still but also when the strings 64 are vibrating.

However, each string 64 is formed by a piano wire or by winding a metal wire around a piano wire, which serves as a core, in a coiled manner. The strings 64 formed from such a material are highly rigid and not flexible. It is thus difficult to extend the strings 64 along the nut surface 71 and bend the strings 64 at predetermined positions just by increasing the angle α between the strings 64 and the inner bottom surfaces 73*a* of the support grooves 73. As a result, the strings 64 separate from the nut surface 71 and form a gap between each string 64 and the nut surface 71. This may generate abnormal noise due to contact between each string 64 and the nut surface 71. For this reason, the fastener 90 is strongly required to minimize the generation of abnormal noise in addition to fixing each string 64 to the nut 68.

SUMMARY OF THE INVENTION

It is an object of the present invention to provide a stringed instrument nut and a stringed instrument that prevent generation of abnormal noise when the instrument is being played.

One aspect of the present invention is a stringed instrument nut for a stringed instrument that includes a body, a neck extending from the body, a head located on a distal end of the neck, and a plurality of strings. Each string has a basal end fixed to the body and a distal end fixed to the head. The stringed instrument nut determines the point of contact between the neck and each string that extends above the neck between the body and the head. The stringed instrument nut includes a nut body, arrangeable on the neck, for supporting each string. A fastener, arranged on the nut body, presses each string against the nut body within a predetermined pressing area and holds each string with the nut body to restrict movement of the string. A projection is arranged on the nut body outside the pressing area in which the fastener presses each string. The projection projects toward each string. The point of contact between the neck and each string is located on a surface of the projection.

Another aspect of the present invention is a stringed instrument for producing music. The stringed instrument includes a body, a neck extending from the body, a head located on a distal end of the neck, and a plurality of strings, each having a basal end fixed to the body and a distal end fixed to the head. A stringed instrument nut determines the point of contact between the neck and each string that extends above the neck between the body and the head. The stringed instrument nut includes a nut body, arranged on the neck, for supporting each string. A fastener, arranged on the nut body, presses each string against the nut body within a predetermined area and holds each string with the nut body to restrict movement of the string. A projection is arranged on the nut body outside the pressing area in which the fastener presses each string. The projection projects toward each string. The point of contact between the neck and each string is located on a surface of the projection.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 4. A stringed instrument nut for a stringed instrument according to the present invention will now be described with the front side, the left side, and the upper side of the instrument defined as viewed from a guitar player and as indicated by arrows in FIG. 1.

Figure 1:
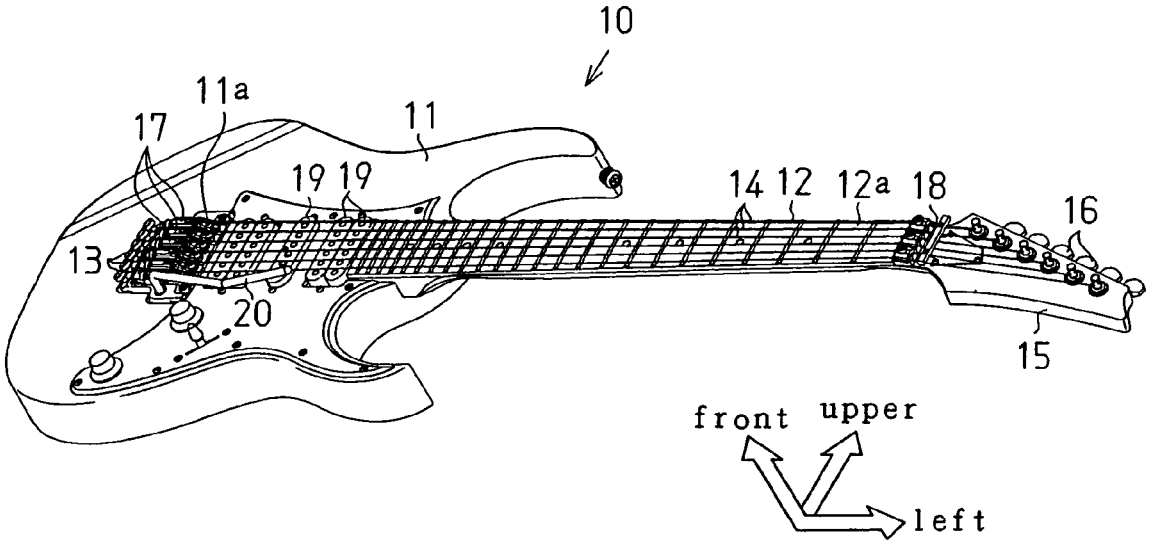
FIG. 1 is a perspective view showing an electric guitar with a nut according to a first embodiment of the present invention.

As shown in FIG. 1, an electric guitar 10 includes a body 11, a neck 12, and six strings 14. A tremolo block 11*a* is arranged on a generally middle portion of the front surface of the body 11. Six tailpieces 13 are arranged on the tremolo block 11*a*. The basal ends of the strings 14 are fixed to the tailpieces 13. The neck 12 extends from the body 11 to the left. A head 15 having six pegs 16 is attached to the distal end of the neck 12. The distal end of each string 14 is wound about and fixed to the corresponding peg 16. Each peg 16 is turned to adjust the tension applied to the corresponding string 14. In the first embodiment, the electric guitar 10 includes a tremolo for a right-handed player.

Six bridges 17 are arranged on the front surface of the body 11. A fingerboard 12*a* is arranged on the surface of the neck 12. A nut 18 is fixed to the distal end of the neck 12 next to the left end of the fingerboard 12*a*. The nut 18, together with the bridges 17, supports the strings 14 in a state spaced from the fingerboard 12*a*. In this state, the strings 14 are stretched over the neck 12 between the body 11 and the head 15.

Further, a plurality of pickups 19 and a tremolo arm 20 are arranged on the front surface of the body 11. Each pickup 19 converts vibration of the corresponding string 14 into an electrical signal. The tremolo arm 20 is used to operate the tremolo. Each pickup 19 is located near the corresponding string 14. An electronic circuit board (not shown) for outputting the electric signals is attached to the body 11. Electric signals output from the electronic circuit board are amplified by an amplifier (not shown), which is externally connected to the electronic circuit board. The amplified signals are output as musical tones by a speaker (not shown). Further, operation of the tremolo arm 20 moves the tailpieces 13 arranged on the tremolo block 11*a* and simultaneously changes the tension applied to the strings 14. This enables the guitar player to play the guitar 10 using the arming technique.

Figure 2:
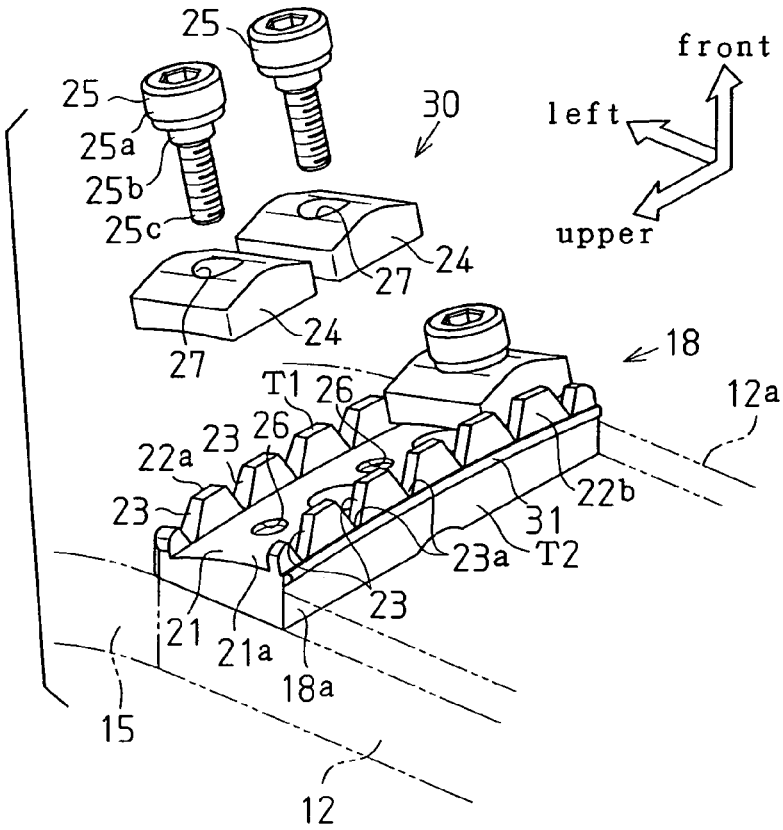
FIG. 2 is an exploded perspective view showing the nut according to the first embodiment.
Figure 3:
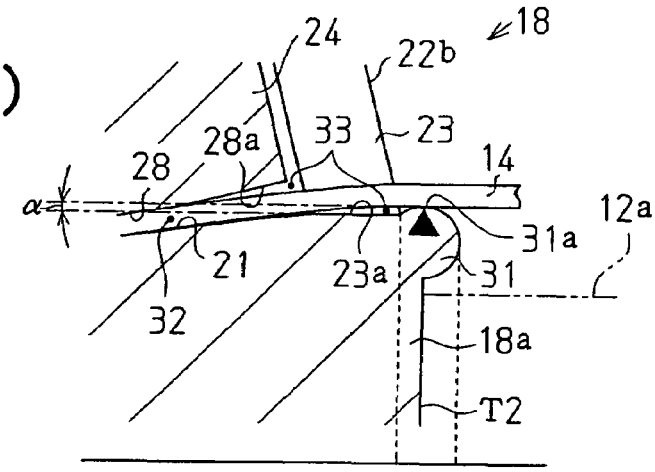
FIG. 3(A) is a cross-sectional view showing a state in which a string that is fixed to the nut is still.
FIG. 3(B) is a cross-sectional view showing a state in which a string that is fixed to the nut is vibrating.
FIG. 3(C) is a cross-sectional view showing a state in which a string that is fixed to the nut is vibrating.
Figure 3:
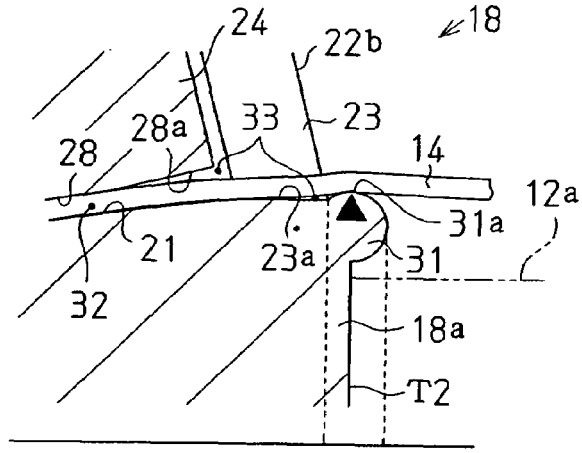
Figure 3:
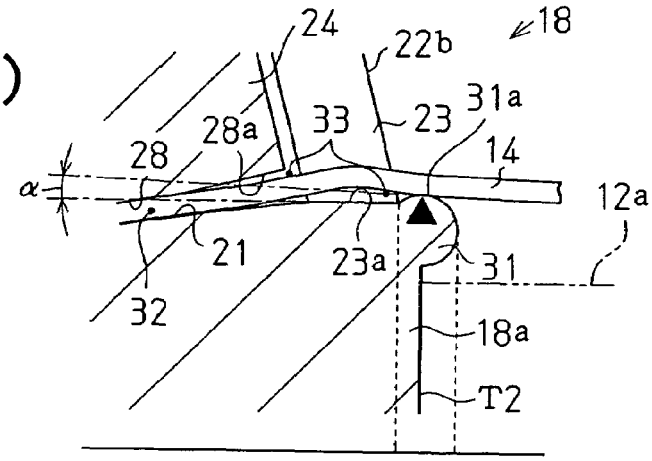

As shown in FIG. 2, the nut 18 includes a nut body 18*a* and a fastener 30. The fastener 30 fixes each string 14 to the nut body 18*a*. The nut body 18*a* is made from metal and substantially rectangular. The nut body 18*a* is fixed to the distal end of the neck 12 by screws. In the first embodiment, the nut body 18*a* has a first end portion T1 and a second end portion T2. The first end portion T1 is adjacent to the head 15. The second end portion T2 is opposite to the first end portion T1 and adjacent to the left end of the fingerboard 12*a*. The nut body 18*a* has a nut surface 21 that is inclined and arcuate so that it rises as the second end portion T2 (the right side in FIG. 2) becomes closer. Further, a second support wall 22*b* extends to the front from the second end portion T2 of the nut surface 21. A first support wall 22*a* extends to the front from the first end portion T1 (the left side in FIG. 2). Each of the first and second support walls 22*a* and 22*b* has six support grooves 23. Each support groove 23 is V-shaped so that it narrows as the surface of the neck 12 becomes closer. The support grooves 23 of the second support wall 22*b* and the support grooves 23 of the first support wall 22*a* face each other. Each string 14 is received by two opposing support grooves 23 so as to restrict movement of each string 14 in the lateral direction of the neck 12.

The fastener 30 includes three pressing members 24 and three adjustment screws 25. The three pressing members 24 are arranged on the nut surface 21. The three adjustment screws 25 fasten the pressing members 24 to the nut surface 21. Three screw holes 26, which are mated with the adjustment screws 25, are formed in the nut surface 21. A through hole 27 for receiving an adjustment screw 25 extends through the middle of each pressing member 24. Each adjustment screw 25 has a head 25*a* and a shaft 25*b*. The shaft 25*b* has female threads 25*c*. The shaft 25*b* is inserted through the through hole 27 so that the adjustment screw 25 is mated with the screw hole 26 in the nut surface 21. The adjustment screws 25 are tightened when the strings 14 are received in the support grooves 23. As a result, each pressing member 24 presses the corresponding two strings 14 against the nut surface 21. Accordingly, each string 14 is fixed to the nut 18 in a state held between the nut surface 21 and bottom surfaces 28 of the pressing members 24.

Figure 4:
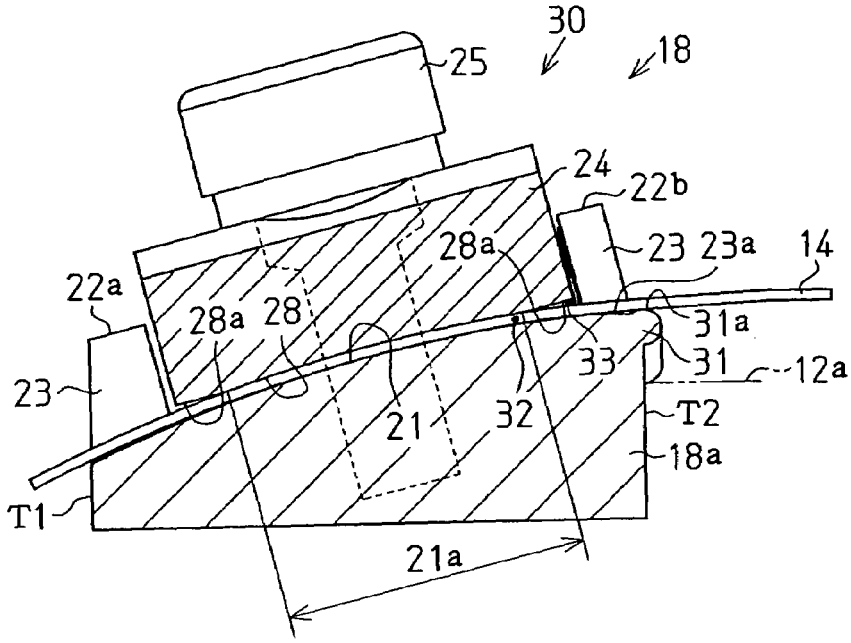
FIG. 4 is a cross-sectional view of the nut of the first embodiment.

Referring to FIGS. 2 and 4, the bottom surface 28 of each pressing member 24 extends along the nut surface 21 of the nut 18. Further, the curvature of two end portions 28*a* of the pressing member 24 is smaller than the curvature of other parts of the pressing member 24. Thus, the gap between the bottom surface 28 of the pressing member 24 and the nut surface 21 increases as the support grooves 23 become closer. Thus, the portions of the nut surface 21 excluding the portions corresponding to the two end portions 28*a* of each pressing member 24, that is, the generally middle portion of the nut surface 21, defines a pressing area 21*a* in which the strings 14 are pressed by the pressing members 24.

A projections 31 is formed on the corner of the second end portion T2 of the nut body 18*a*. The projection 31 projects toward the strings 14. The projection 31 connects inner bottom surfaces 23*a* of the corresponding support grooves 23 at the right side of the support grooves 23. The projection 31 extends in the longitudinal direction of the nut body 18*a*. Further, the projection 31 has a generally semicircular cross-section. The surface of the projection 31 is smoothly curved. The projection 31 has a top surface 31*a*, which is proximate to the strings 14 and located closer to the strings 14 than the inner bottom surfaces 23*a* of the support grooves 23 and the nut surface 21. Each string 14 is supported in a state contacting the top surface 31*a* of the corresponding projection 31 so as to be spaced from the inner bottom surface 23*a* of the corresponding support groove 23. In this state, each string 14 is supported in a manner enabling vibration of the string 14 while being supported by the point of contact with the corresponding bridge 17 and the point of contact with the projection 31 of the nut 18.

Further, each string 14 is held in a fixed state by the corresponding pressing member 24 at a fixed point 32, which is located in the pressing area 21*a*. The fixed point 32 is defined in the pressing area 21*a* at a position that is closest to the second end portion T2. A clearance 33, which serves as an interference avoidance portion, is defined between the strings 14 and the bottom surfaces 28 of the pressing members 24 at positions closer to the second end portion T2 than the fixed point 32, that is, at positions outside the pressing area 21*a*. Further, a clearance 33, which serves as an interference avoidance portion, is also defined between each string 14 and the inner bottom surfaces 23*a* of the corresponding support groove 23 at positions closer to the second end portion T2 than the fixed point 32. In the nut body 18*a*, the clearance 33 is formed between the pressing area 21*a* and the projection 31. When each string 14 that is fixed in the pressing area 21*a* vibrates, the clearance 33 functions to prevent each string 14 from coming into contact with the end portion 28*a* of the corresponding pressing member 24 and with the inner bottom surface 23*a* of the corresponding support groove 23.

Next, the operation of the nut 18 will be described with reference to FIGS. 3(A) to 3(C).

The guitar player first tunes the strings 14 with the pegs 16. The player then plays the electric guitar 10 by plucking each string 14 or by operating the tremolo arm 20. When the electric guitar 10 is being played, the fastener 30 fixes each string 14 to the nut 18. Thus, even when operation of the tremolo arm 20 changes the tension applied to each string 14, movement of each string 14 relative to the nut 18 is restricted. This prevents the tuned strings 14 from going out of tune.

Further, as shown in FIG. 3(A), when each string 14 is still, the string 14 is supported in a state in which it is lifted from below by the projection 31 and spaced from the inner bottom surface 23*a* of the support groove 23. In this state, the string 14 is supported by a point located on the top surface 31*a* of the projection 31 (as indicated by the ▲ symbol in FIG. 3(A)). Thus, the angle a formed between the string 14 and the inner bottom surface 23*a* of the support groove 23 is substantially zero. In this state, tension is also applied to the portion of the string 14 located between the top surface 31*a* of the projection 31 and the fixed point 32. Thus, the portion of the string 14 between the top surface 31*a* of the projection 31 and the fixed point 32 does not loosen. Thus, the string 14 does not come into contact with the inner bottom surface 23*a* of the support groove 23.

FIG. 3(B) shows a state in which the string 14 fixed to the nut 18 is vibrating. In this state, the string 14 vibrates while the string 14 is supported in a manner lifted from below by the projection 31. In the same manner as when the string 14 is still as shown in the state of FIG. 3(A), the point at which the string 14 is supported remains as a point on the top surface 31*a* of the projection 31. In other words, the string 14 is supported so that it is spaced from the inner bottom surface 23*a* of the support groove 23. As a result, the string 14 does not come into contact with the inner bottom surface 23*a* of the support groove 23 and thus does not generate abnormal noise.

FIG. 3(C) shows a state in which the string 14 fixed to the nut 18 is vibrating when the angle $\alpha$ is greater than that in the state shown in FIG. 3(A). The angle $\alpha$ is increased by, for example, changing the shape of the neck 12. In this state, the string 14 vibrates while the string 14 is supported in a manner lifted from below by the projection 31. In the same manner as in the states shown in FIGS. 3(A) and 3(B), the point on which the string 14 is supported remains as a point on the top surface 31*a* of the projection 31. In other words, the string 14 does not extend along the nut surface 21 and is supported in a state spaced from the inner bottom surface 23*a* of the support groove 23. As a result, the string 14 does not come into contact with the inner bottom surface 23*a* of the support groove 23 and thus does not generate abnormal noise.

As described above, due to the nut 18, each string 14 always vibrates in a state supported by a point on the top surface 31*a* of the projection 31 regardless of differences between strings 14 or the vibration magnitude of each string 14. Further, the projection 31 is arranged on the second end portion T2 of the nut 18. Thus, there are no elements that may come into contact with and interfere with each vibrating string 14 in the vicinity of the projection 31. Further, although there are elements of the nut 18 that may come into contact with the strings 14 at the head side of the projections 31, such as the support grooves 23 and the pressing members 24, the strings 14 vibrate in a state supported by the projections 31. Thus, the strings 14 do not contact the support grooves 23 and the pressing members 24. Further, the projection 31 is located closer to the corresponding string 14 than the inner bottom surface 23*a* of the corresponding support groove 23 and the nut surface 21, and the projection 31 lifts the string 14 from below. This ensures that the string 14 is not separated from the projection 31. As a result, the nut 18 of the first embodiment keeps the strings 14 tuned and prevents abnormal noise from being generated when the strings 14 vibrate.

The first embodiment has the advantages described below.

(1) The nut 18 always keeps each string 14 in contact with the top surface 31*a* of the projection 31 when the string 14 vibrates. As a result, the vibration waveform of each string 14 is prevented from being disturbed, and each string 14 is prevented from coming into contact with the inner bottom surface 23*a* of the corresponding support groove 23 or with the end portion 28*a* of the corresponding pressing member 24. Thus, the electric guitar 10 does not generate abnormal noise when it is played. Thus, the electric guitar 10 has high quality and does not generate abnormal noise when being played.

(2) The top surface 31*a* of the projection 31 is located closer to the corresponding string 14 than the inner bottom surface 23*a* of the corresponding support groove 23. Thus, each string 14 is supported in a state spaced from the inner bottom surface 23*a* of the corresponding support groove 23. This prevents each string 14 from coming into contact with the inner bottom surface 23*a* of the corresponding support groove 23 and generating abnormal noise when the string 14 vibrates.

(3) The clearance 33 is defined between each string 14 and the end portion 28*a* of the corresponding pressing member 24 and between each string 14 and the inner bottom surface 23*a* of the corresponding support groove 23. The clearances 33 function to prevent each string 14 from coming into contact with the inner bottom surface 23*a* of the corresponding support groove 23 or with the end portion 28*a* of the corresponding pressing member 24 even when the string 14 strongly vibrates.

(4) The support grooves 23 prevent the strings 14 from moving in the lateral direction of the neck 12. The support grooves 23 are arranged at the head side of the projection 31. This further ensures that each string 14 does not come into contact with the corresponding support groove 23.

(5) The surface of the projection 31 is smoothly curved. This reduces friction resistance caused by contact between the projection 31 and each string 14. Thus, the projection 31 does not form a bending depression on each string 14 and does not break each string 14.

(6) The nut surface 21 is arcuate. Thus, each string 14 is bent more gradually compared to when the nut 18 has a rectangular cross-section or a sharp edge. This minimizes the concentration of stress at the portion where each string 14 is bent.

(7) The projection 31 is located on a corner in the second end portion T2 of the nut body 18*a*. Thus, there are no elements that come into contact with the strings 14 in the vicinity of the second end portion T2. This effectively prevents the generation of abnormal noise in the vicinity of the second end portion T2.

(8) Each support groove 23 is V-shaped and is narrowed as the inner bottom surface 23*a* becomes closer. Further, tension applied to each string 14 urges the string 14 toward the nut surface 21. Thus, each string 14 vibrates in a stable state while movement of the string 14 is prevented at the inner bottom surface 23*a* of the corresponding support groove 23. Further, when replacing a string 14, the V-shaped support grooves 23 enable easy removal of the string 14.

Second Embodiment

A second embodiment of the present invention will now be described with reference to FIGS. 5 and 6. To avoid redundancy, like or same reference numerals are given to those components that are the same as the corresponding components of the first embodiment and will not be described in detail.

Figure 5:
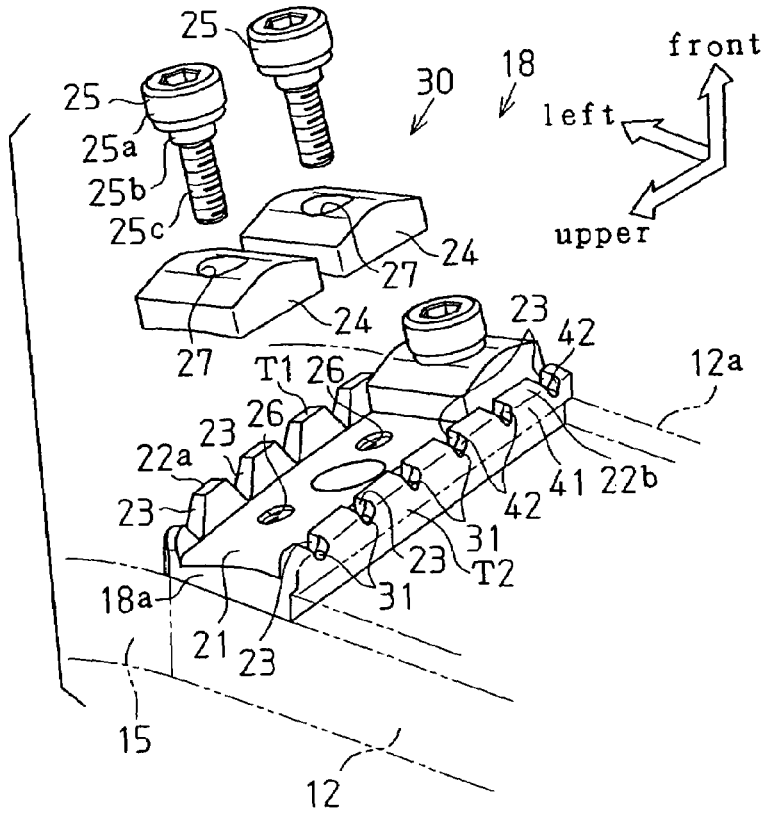
FIG. 5 is an exploded perspective view of a nut according to a second embodiment of the present invention.
Figure 6:
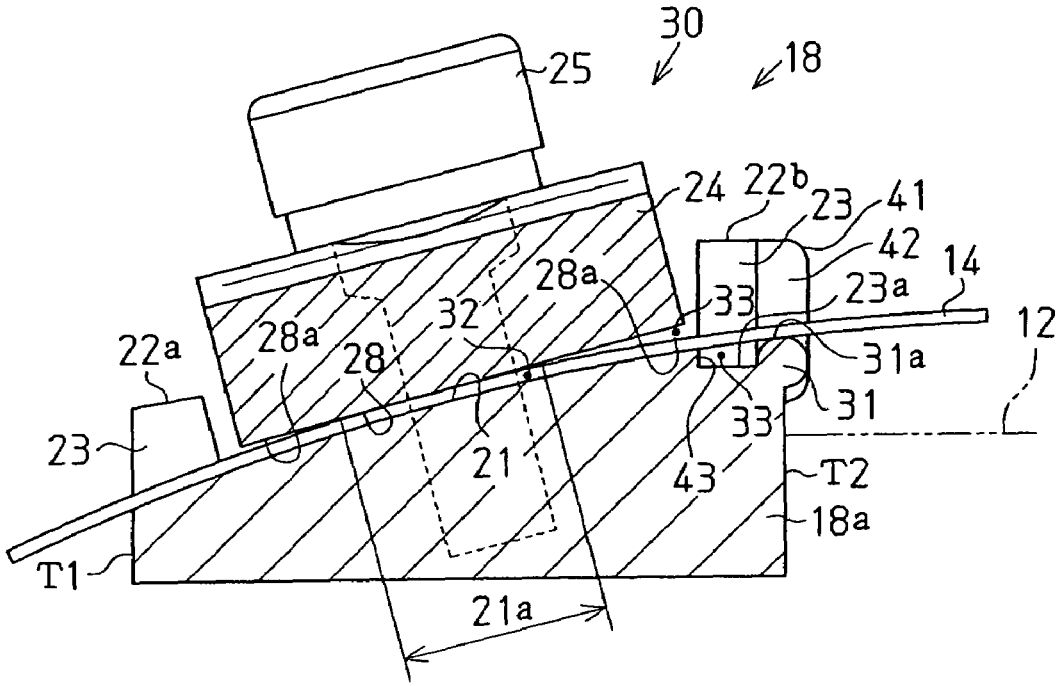
FIG. 6 is a cross-sectional view of the nut of the second embodiment.
Figure 7:
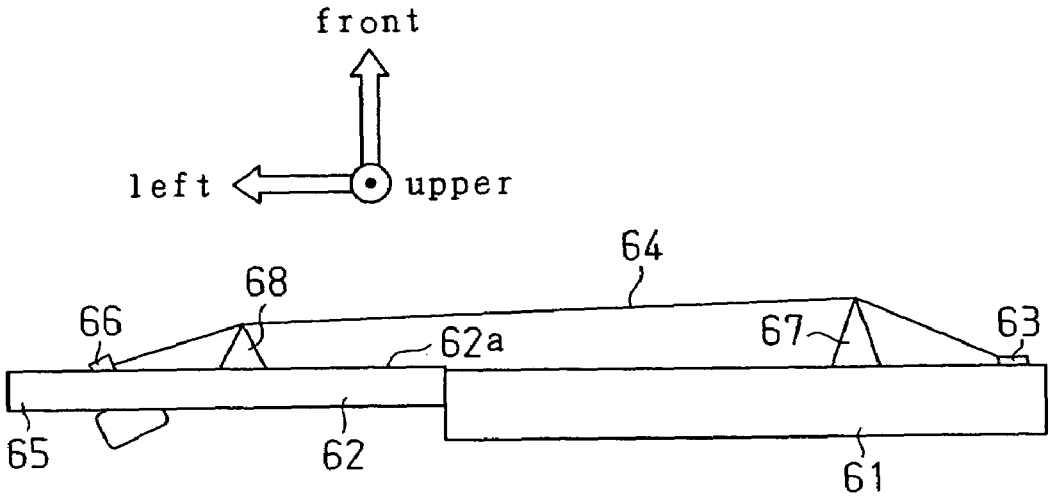
Fig.7 (Prior Art)
FIG. 7 is a schematic view showing the structure of a stringed instrument in the prior art.
Figure 8:
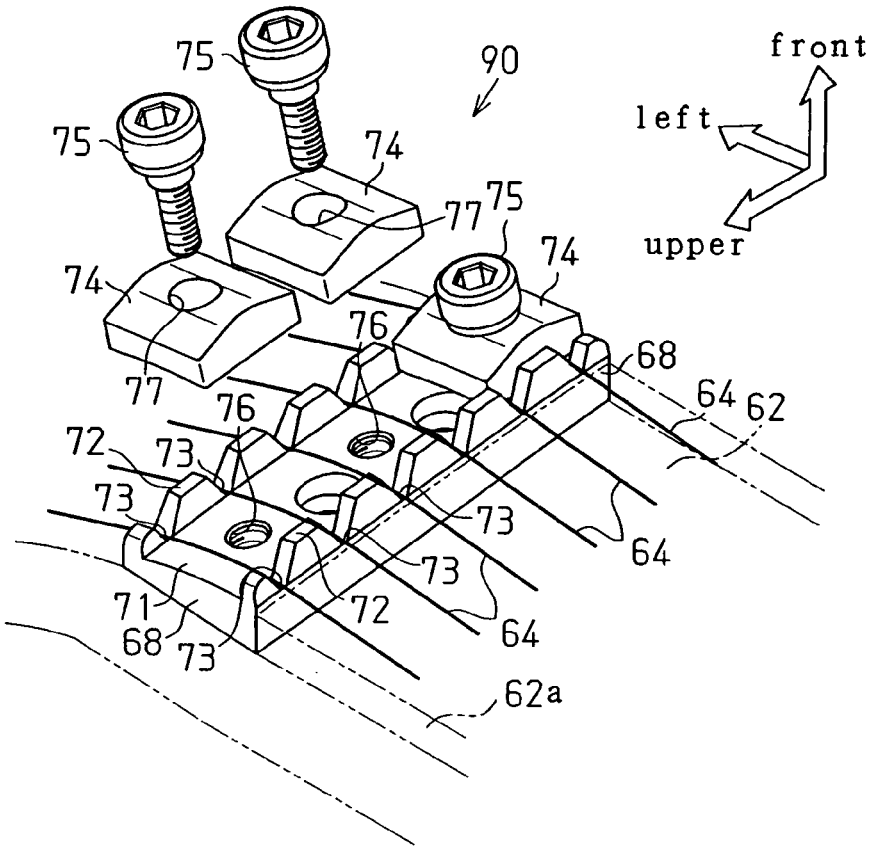
Fig.8 (Prior Art)
FIG. 8 is an exploded perspective view showing a nut in the prior art.
Figure 9:
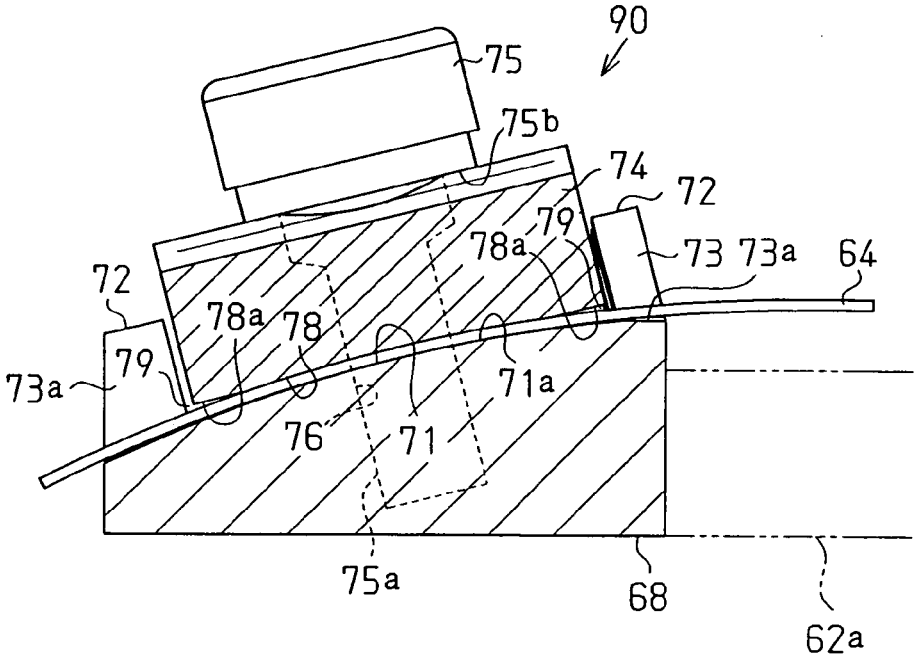
Fig.9 (Prior Art)
FIG. 9 is a cross-sectional view of the prior art nut.
Figure 10A:
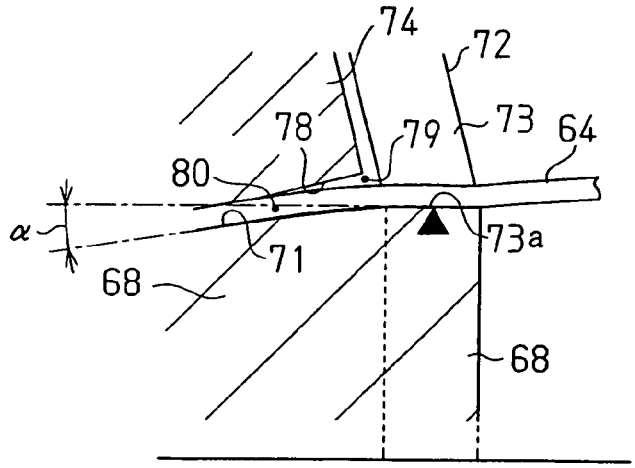
Fig.10(A) (Prior Art)
FIG. 10(A) is a cross-sectional view showing a state in which a string that is fixed to the prior art nut is still.
Figure 10B:
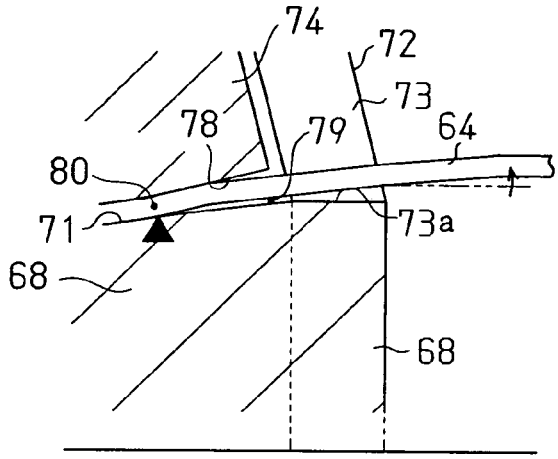
Fig.10(B) (Prior Art)
FIG. 10(B) is a cross-sectional view showing a state in which a string that is fixed to the prior art nut is vibrating.
Figure 10C:
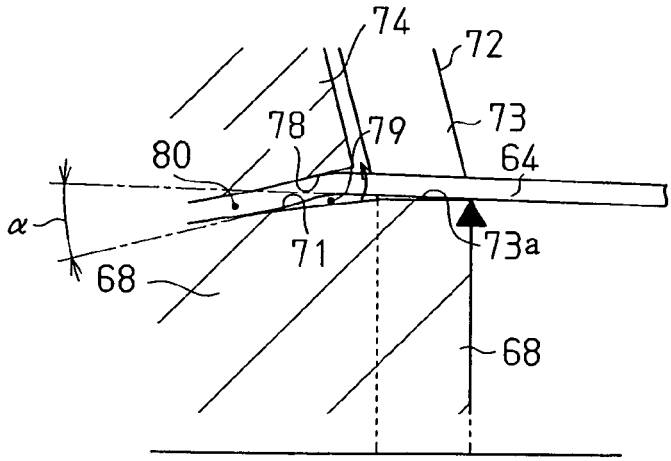
Fig.10(C) (Prior Art)
FIG. 10(C) is a cross-sectional view showing a state in which a string that is fixed to the prior art nut is vibrating.

As shown in FIGS. 5 and 6, a nut 18 has a third support wall 41 that extends toward the bridges 17. The third support wall 41 is formed on an end portion of the second support wall 22*b*. The third support wall 41 has second support grooves 42 that are formed at positions corresponding to support grooves 23 of the second support wall 22*b*. Each second support groove 42 is V-shaped. The two wall surfaces forming each support groove 42 are tapered. Thus, the inner wall surfaces of each second support groove 42 become farther from each other as the second end portion T2 of the nut 18 becomes closer. A projection 31, which is spherical, is formed on an inner bottom portion of each second support groove 42. Further, a stepped portion 43 is formed in the nut surface 21 between the pressing area 21*a* and the inner bottom surface 23*a* of each support groove 23. The stepped portion 43 functions to arrange the inner bottom surface 23*a* of each support groove 23 closer to the surface of the neck 12. Further, a clearance 33, which serves as an interference avoidance portion, is defined between each string 14 and the inner bottom surface 23*a* of the corresponding support groove 23.

The fastener 30 of the nut 18 fixes each string 14, which is arranged in the corresponding pair of support grooves 23 and second support groove 42, to the nut surface 21. In this fixed state, each string 14 is supported so that it is in contact with the top surface 31*a* of the projection 31 and spaced from the inner bottom surface 23*a* of the corresponding support groove 23. The nut 18 enables each string 14 to always vibrate in a state in which it is supported at a point located on the top surface 31*a* of the projection 31 regardless of differences between strings 14 or the vibration magnitude of each string 14.

The second embodiment of the present invention has the advantages described below.

(1) The nut 18 includes the third support wall 41 in addition to the first and second support walls 22*a* and 22*b*. The third support wall 41 includes the second support grooves 42 that are formed at positions corresponding to the support grooves 23 of the support walls 22*a* and 22*b*. In this case, each string 14 is supported by the corresponding support grooves 23 of first and second support walls 22*a* and 22*b* and the corresponding support groove 42 of third support wall 41. This optimally restricts movement of each string 14 in the lateral direction of the neck 12 when each string 14 vibrates.

(2) The support groove 23 of the second support wall 22*b* has the stepped portion 43, which is formed between the inner bottom surface 23*a* and the pressing area 21*a*. The stepped portion 43 arranges the inner bottom surface 23*a* near the surface of the neck 12. Further, the projection 31 greatly projects toward each string 14 from the inner bottom surface 23*a* of each support groove 23. This further prevents each string 14 from being separated from the projection 31 and further prevents each string 14 from coming into contact with the inner bottom surface 23*a* of the corresponding support groove 23.

(3) The projection 31 is formed on the inner bottom surface 23*a* of each second support groove 42. In this case, the second support groove 42 and the projection 31 are arranged at substantially the same position. Thus, regardless of the second support grooves 42, each string 14 is prevented from coming into contact with the second support groove 42 and generating abnormal noise. Further, when molding the nut body 18*a*, the nut body 18*a* may easily be removed from a mold in the vertical direction of the nut body 18*a*. This facilitates the manufacturing of the nut body 18*a* in comparison with the first embodiment.

(4) The inner wall surfaces of each second support groove 42 are tapered. This restricts movement of each string 14 in the lateral direction of the neck 12 while permitting vibration of the string 14. More specifically, when each string 14 vibrates, each string 14 is prevented from coming into contact with the tapered inner surfaces of the corresponding second support groove 42. Thus, regardless of the projection 31 that is formed in the second support groove 42, each string 14 is optimally prevented from coming into contact with the second support groove 42.

It should be apparent to those skilled in the art that the present invention may be embodied in many other specific forms without departing from the spirit or scope of the invention. Particularly, it should be understood that the present invention may be embodied in the following forms.

In each of the above embodiments, the electric guitar 10 includes a tremolo. However, the tremolo may be eliminated from the electric guitar 10. Further, although the electric guitar 10 has six strings 14 in the above embodiments, the electric guitar 10 may have any number of strings 14. The electric guitar 10, which serves as a stringed instrument, may be changed to other stringed instruments, such as an acoustic guitar, a semi-acoustic guitar, an electric acoustic guitar, or a bass guitar.

The shape of the projection 31 may be changed to have a triangular cross-section, a square cross-section, or a hexagonal cross-section.

The projection 31 may be formed by a group of non-successive projections.

The nut 18 may solely be distributed as, for example, a spare part.

The nut 18 may include a further member for pressing each string 14 against the projection 31. This further prevents each string 14 from being separated from the projection 31.

The present examples and embodiments are to be considered as illustrative and not restrictive, and the invention is not to be limited to the details given herein, but may be modified within the scope and equivalence of the appended claims.

The invention claimed is:

1. A stringed instrument nut for a stringed instrument having a body, a neck extending from the body, a head located on a distal end of the neck, and a plurality of strings, each string of the plurality of strings having a basal end fixed to the body and a distal end fixed to the head, wherein the stringed instrument nut determines a point of contact between the neck and each string that extends above the neck between the body and the head, the stringed instrument nut comprising:

a nut body configured to be positioned on the neck and to support each string;

a fastener arranged on the nut body and configured to press each string against the nut body within a predetermined pressing area and to hold each string with the nut body to restrict movement of the string; and a projection arranged on the nut body outside the pressing area in which the fastener presses each string, the projection projecting toward each string, wherein the point of contact between the neck and each string is located on a surface of the projection, wherein the nut body includes an interference avoidance portion positioned between the pressing area and the projection, the interference avoidance portion configured to prevent contact between each string and other elements when the string vibrates.

2. The stringed instrument nut according to claim 1, wherein the nut body further includes a support groove, arranged between the projection and the pressing area, for restricting movement of the strings in a lateral direction of the neck.

3. The stringed instrument nut according to claim 2, wherein the projection is arranged in the support groove.

4. The stringed instrument nut according to claim 2, wherein the projection extends along an inner bottom surface of the support groove.

5. The stringed instrument nut according to claim 1, wherein the nut body further includes a support groove, arranged between the projection and the pressing area, for restricting movement of the strings in a lateral direction of the neck.

6. The stringed instrument nut according to claim 5, wherein the projection is arranged in the support groove.

7. The stringed instrument nut according to claim 5, wherein the projection extends along an inner bottom surface of the support groove.

8. The stringed instrument nut according to claim 1, wherein the projection has an arcuate surface.

9. The stringed instrument nut according to claim 8, wherein the arcuate surface of the projection of the nut body extends into the pressing area, and the fastener has a surface facing toward the pressing area and has a curvature that is less than that of the nut body.

10. The stringed instrument nut according to claim 1, wherein the nut body has a first end portion adjacent to the head and a second end portion located opposite to the first end portion, the projection being arranged in the second end portion.

11. The stringed instrument nut according to claim 2, wherein the support groove narrows as an inner bottom surface of the support groove becomes closer.

12. The stringed instrument nut according to claim 1, wherein the fastener includes a pressing member arranged on the nut body and a fastening member for fastening the pressing member to the nut body.

13. The stringed instrument nut according to claim 12, wherein two of the strings are pressible against the nut body by the pressing member.

14. In combination, the stringed instrument nut of claim 1 and the stringed instrument for producing music comprising the head, the neck, the body and the plurality of strings.

15. A stringed instrument for producing music, the stringed instrument comprising:

a body, a neck extending from the body, a head located on a distal end of the neck, and a plurality of strings, each string of the plurality of strings having a basal end fixed to the body and a distal end fixed to the head;

a stringed instrument nut configured to determine a point of contact between the neck and each string that extends above the neck between the body and the head, the stringed instrument nut including:

a nut body arranged on the neck configured to support each string;

a fastener arranged on the nut body and configured to press each string against the nut body within a predetermined area and to hold each string with the nut body to restrict movement of the string; and a projection arranged on the nut body outside the pressing area in which the fastener presses each string, the projection projecting toward each string, wherein the point of contact between the neck and each string is located on a surface of the projection, wherein the nut body includes an interference avoidance portion positioned between the pressing area and the projection, the interference avoiding portion configured to prevent contact between each string and other elements when the string vibrates.

16. The stringed instrument according to claim 15, further comprising:

a tremolo for changing tension that is applied to each string to change a tone of the string.

17. A stringed instrument nut for a stringed instrument having a neck and a plurality of strings extending therealong in a tensionable state, the stringed instrument nut comprising:

a nut body configured to be positioned on the neck and configured to support each string;

a fastener arranged on the nut body and configured to press each string against the nut body within a predetermined pressing area and to hold each string with the nut body to restrict movement of the string; and a projection arranged on the nut body outside the pressing area in which the fastener presses each string, the projection configured to form a point of contact between the neck and each strings, wherein the nut body includes an interference avoidance portion positioned between the pressing area and the projection, the interference avoiding portion configured to prevent contact between each string and other elements when the string vibrates.

18. The stringed instrument nut according to claim 17, wherein the nut body further includes a support groove, arranged between the projection and the pressing area, for restricting movement of the strings in a lateral direction of the neck.

19. The stringed instrument nut according to claim 18, wherein the projection is arranged in the support groove.

20. A stringed instrument nut for a stringed instrument having a body, a neck extending from the body, a head located on a distal end of the neck, and a plurality of strings, each string of the plurality of strings having a basal end fixed to the body and a distal end fixed to the head, wherein the stringed instrument nut determines a point of contact between the neck and each string that extends above the neck between the body and the head, the stringed instrument nut comprising:

a nut body configured to be positioned on the neck and to support each string;

a fastener positioned on the nut body and configured to press each string against the nut body within a predetermined pressing area and to hold each string at the nut body to restrict movement of the string; and a projection arranged on the nut body outside the pressing area in which the fastener presses each string, the projection projecting toward each string, wherein the point of contact between the neck and each string is located on a surface of the projection, and wherein the arcuate surface of the projection extends into the pressing area, and the fastener has a surface facing toward the pressing area and has a curvature that is less than that of the nut body.

* * * * *